US005894751A

United States Patent [19]

Bourgoine et al.

[11] Patent Number: 5,894,751

[45] Date of Patent: Apr. 20, 1999

[54] SHROUD CANISTER

[76] Inventors: Jeffrey J. Bourgoine, 3303 Porter Ave., Ogden, Utah 84403; William C. Karcher, 442 S. State St., #125, Clearfield, Utah 84015; Steven F. Locher, 21 Pine Valley Cir., Moultrie, Ga. 31768

[21] Appl. No.: 08/814,704

[22] Filed: Mar. 11, 1997

[51] Int. Cl.[6] ..... B21B 9/00

[52] U.S. Cl. ..... 72/38; 72/253.1; 72/271

[58] Field of Search ..... 72/38, 253.1, 257, 72/261, 270, 271, 272

[56] References Cited

U.S. PATENT DOCUMENTS

| | | | |
|---|---|---|---|
| 3,342,055 | 9/1967 | Blankenship et al. | 72/38 |
| 4,829,802 | 5/1989 | Baumann | 72/272 |

FOREIGN PATENT DOCUMENTS

| | | | |
|---|---|---|---|
| 40-8813 | 5/1965 | Japan | 72/38 |
| 63-313612 | 12/1988 | Japan | 72/38 |
| 1-95812 | 4/1989 | Japan | 72/38 |

*Primary Examiner*—Joseph J. Hail, III
*Assistant Examiner*—Ed Tolan
*Attorney, Agent, or Firm*—Thompson E. Fehr

[57] ABSTRACT

A shroud canister for reducing the oxidation of extruded metal in an extrusion press. The shroud canister introduces a relatively inert substance which is gaseous at standard temperatures and pressures into the bore of the platen of an extrusion press, confines the relatively inert substance with the bore of the platen, and precludes any of the relatively inert substance which is in liquid form from coming into contact with the extruded metal. In one embodiment, the shroud canister consists of a faceplate to be attached to the platen of the extrusion press, a fluid supply tube to inject the relatively inert substance into the bore of the platen, and a shield to preclude any of the relatively inert substance which is in liquid form upon leaving the fluid supply tube from coming into contact with the extruded metal. A second embodiment consists of a cylindrical canister having one or more product apertures for the extruded metal and a main relatively inert substance supply cavity communicating with secondary relatively inert substance supply cavities to inject the relatively inert substance into the product apertures.

6 Claims, 4 Drawing Sheets

SHROUD CANISTER

BACKGROUND OF THE INVENTION

1. Field of the Invention

This invention relates to a device and method for improving extrusion, particularly but not exclusively for easily oxidized metals, especially aluminum and aluminum alloys.

2. Description of the Related Art

In the process of extruding aluminum, a ram is pushed from a hydraulic cylinder against a billet of aluminum which is slidably held within a container that is heated to high temperatures.

The heated aluminum billet is, consequently, pushed through a die that is housed in a die ring and supported by a bolster, through the bolster, and through a platen to provide the desired shape for the extruded piece or pieces of aluminum.

At the high temperature of the aluminum, any contact of the surface of the aluminum with oxygen produces an aluminum oxide on the surface of the extruded piece or pieces of aluminum which degrades the quality of the finished product.

To reduce the possibility of such oxidation, an inert gas, especially nitrogen, has traditionally been pumped into the die ring and from the die ring into the cavities within the die which assist in producing the desired shape of the aluminum piece or pieces. Also, the speed at which the aluminum is pushed through this process of extrusion is maintained low in order to enable the aluminum piece or pieces to cool significantly before they exit the platen.

U.S. Pat. No. 3,808,865 provides, in lines 34 through 47 of column 2, "As has been mentioned already in connection with the known extrusion methods, the formation of an oxide layer at the downstream end of the tool, i.e., at the end of the working surface, is increased by the presence of atmospheric oxygen and by an increased deformation heat in the tool. By the total displacement of the atmospheric oxygen the formation of the oxide layer can suitably be avoided, so that with the optimum removal of heat an additional increase of extrusion speed with tolerance of an increase tool temperature becomes possible. Accordingly the invention can be advantageously embodied in that gaseous nitrogen is directed from the tool in the direction towards the downstream end of the tool."

In lines 53 through 57 of column 3 and line 65 of column 3 through line 9 of column 4, U.S. Pat. No. 3,808,865 explains that "[t]he tool 16 consists, in the direction of flow of the metal which is flowing through extrusion pressure, of the die 28 which is provided with a mandrel 29 fixed to a bridge . . . The die 28 with insert 32 are set in a holder 33, which abuts through a sealing ring 34 on a pressure ring 35, which in turn is received in a pressure ring holder 36. In this case a channel shaped recess 37 is provided . . . , extending annularly in the pressure ring 35, from which passages 38 open near the downstream end of the working surface 31. In the recess 37 open two delivery pipes 39 for production of a uniform removal of heat from the tool 16, and the coolant [liquid nitrogen which goes from a liquid to a gaseous state] supplied flows through the outlet opening 40 into the respective cavities 41 and 42 of the pressure ring 35 and pressure ring holder 36 . . . "

Similarly, line 67 of column 2 through line 2 of column 3 in U.S. Pat. No. 5,133,126 state that " . . . an inert gas, for example, nitrogen gas or argon gas is blown into the extrusion die in the invention because the surface of the aluminum . . . might otherwise become oxidized at high temperature . . . "

Contrary to the suggestion in U.S. Pat. No. 3,808,865, however, oxygen is not totally displaced throughout the portion of the extrusion press following the die.

Three other patents protect from oxidation only the inner surface of a tube. These are U.S. Pat. Nos. 4,316,373; 4,578,973; and 4,860,565.

From line 66 of column 3 through line 2 of column 4, U.S. Pat. No. 4,316,373 provides, "To extrude a billet 11 into a tube 17, the tip of the mandrel 16 is pressed through the billet 11, which is provided with a center bore, into the opening of the die 7 and in doing so widens the bore and centers the billet." The patent continues, "Protective gas is conveyed through the inner pipe 25 through a feed pipe 29 from the back of the mandrel holder carrier 14 to the mandrel tip 27 and flows through a bore 30 into the inside of the copper tube 17 being formed in the extrusion process."

Lines 59 through 62 of column 2 in U.S. Pat. No. 4,578,973 state, "[A]n inert gas alone or a mixture of oxygen and inert gas may be supplied to the hollow portion [of the tube] from the start of extrusion of the shaped material." Then, on lines 43 through 47 of column 3, the patent clarifies, "The male die 4 is centrally formed with a gas injection outlet 8. A gas channel 10 extending from a gas inlet 9 in the lower end of the die holder 6 to the outlet 8 is formed in the male die 4 and the die holder 6." U.S. Pat. No. 4,860,565 is identical to U.S. Pat. No. 4,578,973 except that it employs dry air or pure oxygen instead of an inert gas or a mixture of oxygen and inert gas.

Rather than pumping an inert gas into the die ring and from the die ring into the cavities within the die which assist in producing the desired shape of the aluminum piece or pieces, the method of U.S. Pat. No. 4,499,708 involves enclosing the entire extrusion press within a container of inert gas. Although minimizing the possibility of ignition of the reactive material with which that method deals, it would be too cumbersome for the commercial production of ordinary metals such as aluminum.

Two further patents—U.S. Pat. Nos. 5,054,303 and 5,392,628—use an opposite technique to the insertion of an inert gas. In the area around the ram, the billet, and the die, the devices of these two patents create a vacuum. Such a vacuum does not, however, extend beyond the die into the bore of the extrusion press.

SUMMARY OF THE INVENTION

The present process adds to the traditional process of pumping nitrogen through the die ring into space around the die, the injection of a relatively inert substance which is gaseous at standard temperatures (approximately 24° C.) and pressures (approximately 760 mm of Hg), preferably nitrogen, directly into the bore of the platen. This has been found significantly to reduce oxygen in the platen and, consequently, to lessen oxidation on the surface of the finished extruded metal, such as an aluminum piece or pieces, as compared with the traditional process of only injecting nitrogen from the die ring. Furthermore, the expansion of such relatively inert substance within the bore of the platen absorbs thermal energy, thereby increasing the rate of cooling of the finished extruded metal, which decreases the time when the finished extruded metal will be at temperatures sufficiently high for oxidation to occur. This has the secondary benefit of permitting a billet of aluminum to be processed more rapidly. The faster processing creates more friction, which generates more heat; but the absorption of thermal energy compensates, within a sufficiently short period of time to minimize the possibility of oxidation, for such increased generation of heat.

Thus, the present invention both increases the quality of the finished aluminum piece or pieces and decreases processing time.

DESCRIPTION OF THE PREFERRED EMBODIMENT

Figure 1:
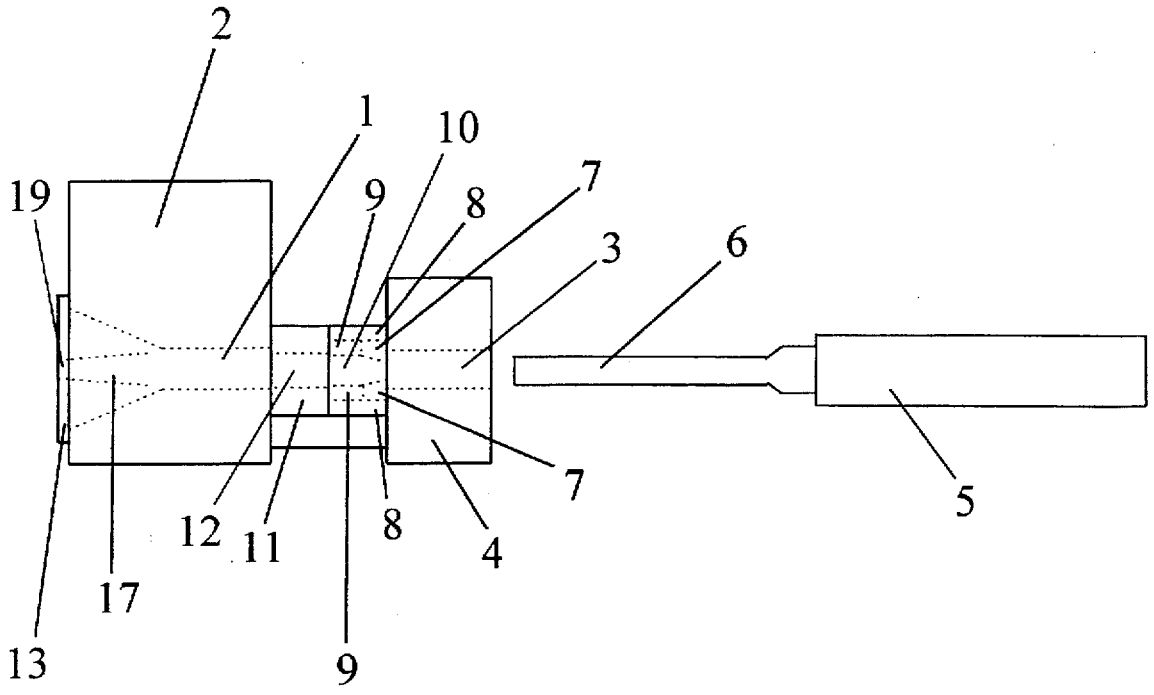
FIG. 1 illustrates an extrusion press having installed, within the bore of such extrusion press, the Shroud Canister, in the embodiment to be used for a large piece of extruded metal.

The process of the present invention involves injecting a relatively inert substance which is gaseous at standard temperatures and pressures, preferably nitrogen, directly into the bore 1 of the platen 2 of an extrusion press, as depicted in FIG. 1.

The process of the present invention can be used independently but is preferably employed in conjunction with the process that is well known in the art of pumping nitrogen into the die ring and from the die ring into the cavities within the die which assist in producing the desired shape of an aluminum piece or pieces.

For clarity of understanding, the operation of the extrusion press will first be considered.

A billet (not shown) of metal is slidably placed in an aperture 3 within the container 4. The container 4 is heated to a high temperature. An hydraulic cylinder 5 forces a ram 6 toward the heated billet, pushing the heated billed through a die 7 which is held in place by a die ring 8 and a backer 9.

The backer has an aperture 10 to accommodate the extruded metal (not shown) from the billet. Between the backer 10 and the platen 2 is located a bolster 11, which also has an aperture 12 to accommodate the extruded metal.

Figure 2:
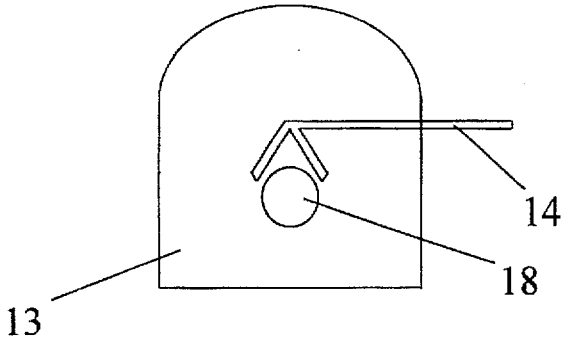
FIG. 2 is a view from the end of the Shroud Canister, in the embodiment to be used for a large piece of extruded metal, that is intended to face away from the bore of the extrusion press.
Figure 3:
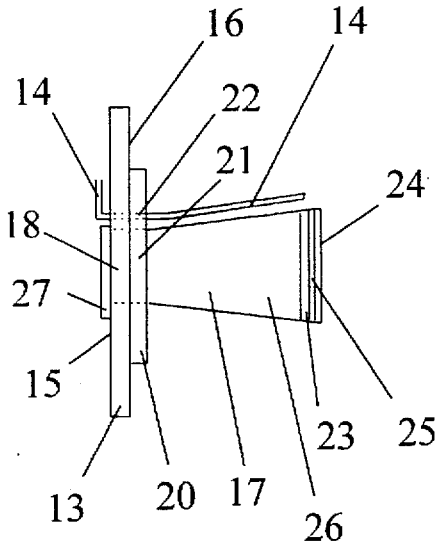
FIG. 3 shows a side view of the Shroud Canister, in the embodiment to be used for a large piece of extruded metal.
Figure 4:
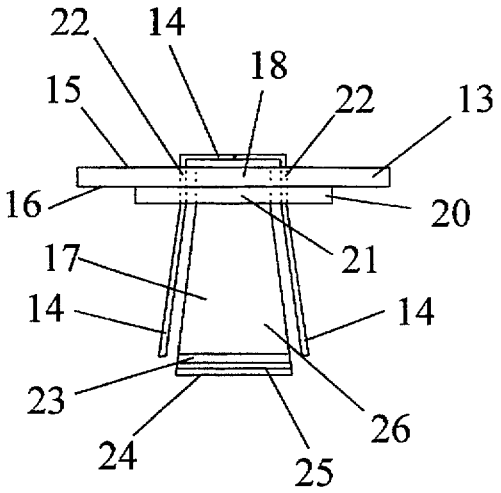
FIG. 4 gives a view from above the Shroud Canister, in the embodiment to be used for a large piece of extruded metal.

For a larger, single piece of extruded metal, the introduction of the relatively inert substance is accomplished with the Shroud Canister depicted in FIG. 2, FIG. 3, and FIG. 4. A faceplate 13 is adapted for attachment to the platen 2, preferably with bolts. A fluid supply tube 14 runs from a first side 15 of the faceplate, through the faceplate 13, and beyond a second side 16 of the faceplate 13 such a distance that the fluid supply tube 14 will extend into the bore 1 of the platen 2 when the faceplate 13 has been attached to the platen 2. Preferably, a shield 17 is attached to the second side 16 of the faceplate 13.

When the faceplate 13 has been attached to the platen 2, the relatively inert substance which is gaseous at standard temperatures and pressures is injected into the bore 1 of the platen 2 through the fluid supply tube 14. (In the preferred embodiment, two fluid supply tubes 14 actually are present to perform this function.) The faceplate 13, itself, tends to retard the introduction of oxygen into, and confine the relatively inert substance within, the bore 1 of the platen 2.

The shield 17 preferably runs completely around an aperture 18 which exists in the faceplate to permit the extruded metal to exit the extrusion press. In any event, the shield 17 is so positioned with respect to the fluid supply tube 14 and extends away from the second side 16 of the faceplate 13 a sufficient distance that the shield 17 assures that any of the relatively inert substance which is in liquid form upon leaving the fluid supply tube 14 cannot come into contact with the extruded metal. The shield 17 can have a cylindrical or any other shape that permits the extruded metal to transit the shield 17 while also protecting the extruded metal from any of the relatively inert substance which is in liquid form upon leaving the fluid supply tube 14. As depicted in FIG. 1, FIG. 3 and FIG. 4, a truncated cone is, however, a preferable shape for a platen 2 which has a bore 1 that expands as it nears the exit 19 of the extrusion press. In the preferred embodiment, an annular thermal insulator 20, having an aperture 21 that is to be approximately aligned with and is of approximately the same dimensions as the aperture 18 in the faceplate 13 and also having an additional aperture 22 to accommodate the fluid supply tube 14, is attached to the second side 16 of the faceplate 13.

Optionally, to prevent scratching of the extruded metal, the portion of the shield 17 that is designed to face the extruded metal is lined with Kevlar 23, which preferably extends beyond the unattached end 24 of the shield 17 and is then folded back onto, and attached—preferably with a hose clamp 25—to, the exterior 26 of the shield 17. Optionally, Kevlar strips 27 may be hung across the first side 15 of the faceplate 13 in order to cover the aperture 18 in the faceplate 13. This further retards the introduction of oxygen into the bore 1 of the platen 2 and to confine the relatively inert substance within the bore 1 of the platen 2. As the metal exits the aperture 18 of the faceplate 13, such extruded metal then pushes aside only such Kevlar strips 27 as are necessary to permit the extruded metal to leave the platen 2.

Figure 5:
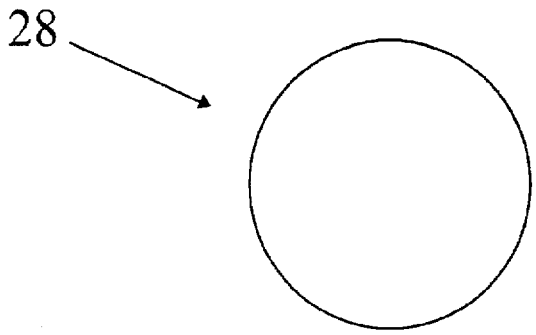
FIG. 5 is an end view of the hollow cylindrical tube.
Figure 6:
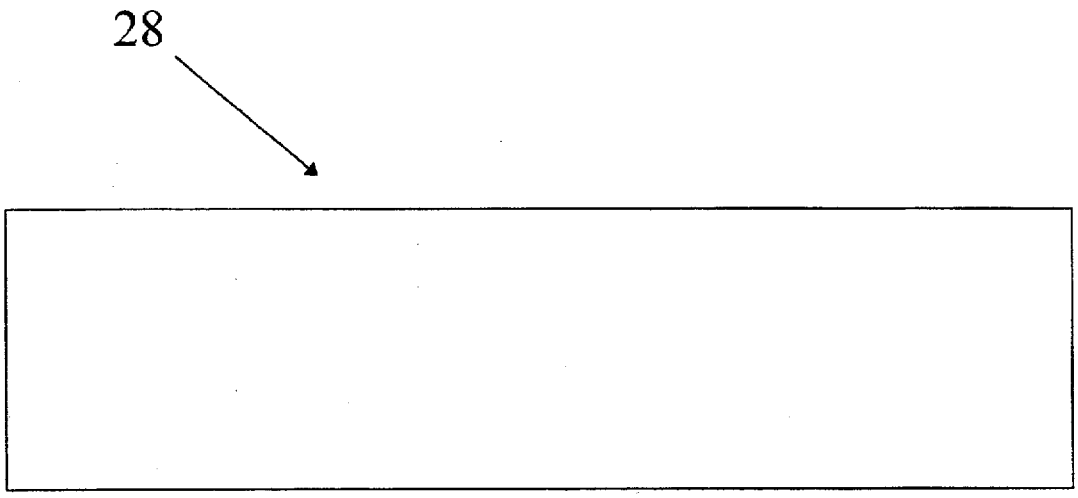
FIG. 6 portrays the hollow cylindrical tube from the side.

To preclude the leading edge of the extruded metal from tearing the Kevlar 23 which lines the hollow core of the shield 17, a hollow cylindrical tube 28, which is illustrated in FIG. 5 and FIG. 6, having an inner diameter slightly smaller than the diameter of the aperture 18 in the faceplate 13 is introduced through the aperture 18 of the faceplate 13 and extended beyond the unattached end 24 of the shield 17 into the bore 1 of the platen 2 before the leading edge of the extruded metal piece or pieces enters the shield 17.

Figure 7:
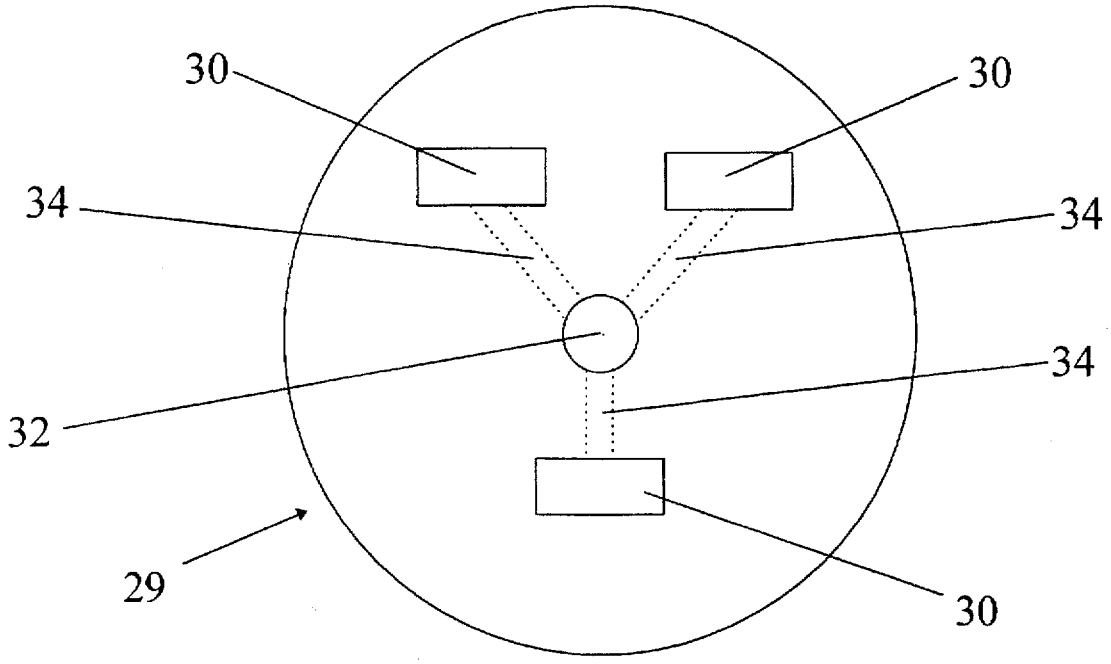
FIG. 7 depicts an end view of the Shroud Canister, in the embodiment to be used for smaller pieces of extruded metal.
Figure 8:
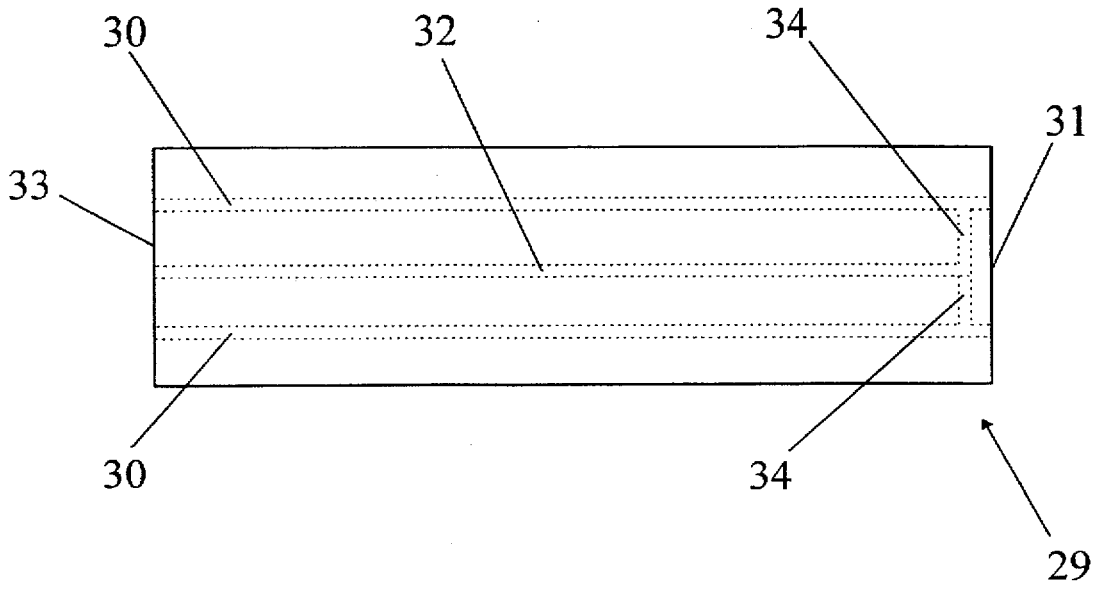
FIG. 8 provides a side view of the Shroud Canister, in the embodiment to be used for smaller pieces of extruded metal.

For one or more smaller pieces of extruded metal, the introduction of the relatively inert substance is accomplished with the Shroud Canister illustrated in FIG. 7 and FIG. 8.

In the standard extrusion process for one or more smaller pieces of extruded metal, a cylindrical canister 29 is traditionally utilized. The cylindrical canister 29 is preferably constructed of a carbon-graphite composite material and is covered with metal on the outside. One or more product apertures 30 are formed in the cylindrical canister 29 to accommodate the pieces of extruded metal. As its name implies, the traditional cylindrical canister 29 has the same cross-sectional shape throughout its length. The cylindrical canister 29 is traditionally inserted into the bore 1 of the platen 2 so far that a first end 31 of the cylindrical canister 29 abuts the bolster 11.

The present invention modifies the traditional cylindrical canister 29 by forming, preferably by drilling, a main relatively inert substance supply cavity 32 running from a second end 33 of the cylindrical canister 29, which second end 33 is designed to be maintained outside the bore 1 of the platen 2, to near the first end 31 of the cylindrical canister 29. For each product aperture 30, a secondary relatively inert substance supply cavity 34 communicates, preferably near the first end 31 of the cylindrical canister 29, with such product aperture 30 and with the main relatively inert substance supply cavity 32 so that the relatively inert substance can be injected, through the main relatively inert substance supply cavity 32 and the secondary relatively inert substance supply cavities 34, into the product apertures.

Experimentation has demonstrated that the process of injecting nitrogen into the bore 1 of the platen 2 has significantly reduced oxidation to the surface of extruded aluminum below levels achieved by the introduction of nitrogen through the die ring 8 alone and has, similarly, substantially decreased the time required to extrude the aluminum as compared to the process when nitrogen is introduced through the die ring 8 alone.

We claim:

1. A shroud canister for reducing the oxidation of extruded metal in an extrusion press, which comprises:

a faceplate adapted for attachment to the platen of an extrusion press, said faceplate having an aperture to permit extruded metal to exit the extrusion press and said faceplate, when attached to the platen, tending to retard the introduction of oxygen into, and tending to confine the relatively inert substance with, the bore of the platen;

a fluid supply tube running from a first side of the faceplate, through the faceplate, and beyond a second side of the faceplate such a distance that the fluid supply tube will extend into the bore of the platen when said faceplate has been attached to the platen, said fluid supply tube being used to inject the relatively inert substance into the bore of the platen when the faceplate has been attached to the platen;

an annular thermal insulator, having an aperture that is to be approximately aligned with and is of approximately the same dimensions as the aperture in the faceplate, attached to the second side of the faceplate; and Kevlar strips hung across the first side of the faceplate in order removably to cover the aperture in the faceplate to further retard the introduction of oxygen into the bore of the platen and to confine the relatively inert substance within the bore of the platen.

2. The shroud canister for reducing the oxidation of extruded metal in an extrusion press as recited in claim 1, wherein:

the relatively inert substance is nitrogen.

3. A shroud canister for reducing the oxidation of extruded metal in an extrusion press, which comprises:

a faceplate adapted for attachment to the platen of an extrusion press, said faceplate having an aperture to permit extruded metal to exit the extrusion press and said faceplate, when attached to the platen, tending to retard the introduction of oxygen into, and tending to confine the relatively inert substance with, the bore of the platen;

a fluid supply tube running from a first side of the faceplate, through the faceplate, and beyond a second side of the faceplate such a distance that the fluid supply tube will extend into the bore of the platen when said faceplate has been attached to the platen, said fluid supply tube being used to inject the relatively inert substance into the bore of the platen when the faceplate has been attached to the platen; and a shield attached to the second side of the faceplate, said shield being so positioned with respect to the fluid supply tube and extending away from the second side of the faceplate a sufficient distance that said shield assures that any of the relatively inert substance which is in liquid form upon leaving the fluid supply tube cannot come into contact with the extruded metal.

4. The shroud canister for reducing the oxidation of extruded metal in an extrusion press as recited in claim 3, wherein:

the relatively inert substance is nitrogen.

5. The shroud canister for reducing the oxidation of extruded metal in an extrusion press as recited in claim 4, further comprising:

an annular thermal insulator, having an aperture that is to be approximately aligned with and is of approximately the same dimensions as the aperture in the faceplate, attached to the second side of the faceplate;

Kevlar strips hung across the first side of the faceplate in order removably to cover the aperture in the faceplate to further retard the introduction of oxygen into the bore of the platen and to confine the relatively inert substance within the bore of the platen; and Kevlar lining the portion of the shield that is designed to face the extruded metal in order to prevent scratching of the extruded metal.

6. The shroud canister for reducing the oxidation of extruded metal in an extrusion press as recited in claim 5, wherein:

the relatively inert substance is nitrogen.

* * * * *